US011611184B2

(12) United States Patent
Dropmann et al.

(10) Patent No.: US 11,611,184 B2
(45) Date of Patent: Mar. 21, 2023

(54) SLIP RING ASSEMBLY

(71) Applicant: STEMMANN-TECHNIK GMBH, Schuettorf (DE)

(72) Inventors: Frank Dropmann, Rheine (DE); Rene Kristen, Nordhorn (DE); Dirk Lotgering, Schuettdorf (DE)

(73) Assignee: STEMMANN-TECHNIK GMBH, Schuettorf (DE)

( * ) Notice: Subject to any disclaimer, the term of this patent is extended or adjusted under 35 U.S.C. 154(b) by 114 days.

(21) Appl. No.: 17/269,864

(22) PCT Filed: Aug. 20, 2019

(86) PCT No.: PCT/DE2019/100751
§ 371 (c)(1),
(2) Date: Feb. 19, 2021

(87) PCT Pub. No.: WO2020/038530
PCT Pub. Date: Feb. 27, 2020

(65) Prior Publication Data

US 2021/0242646 A1 Aug. 5, 2021

(30) Foreign Application Priority Data

Aug. 21, 2018 (DE) ..... 10 2018 120 326.8

(51) Int. Cl.
*H01R 39/56* (2006.01)
*H01R 43/00* (2006.01)
*H01R 43/14* (2006.01)

(52) U.S. Cl.
CPC ..... *H01R 39/56* (2013.01); *H01R 43/002* (2013.01); *H01R 43/14* (2013.01)

(58) Field of Classification Search
CPC ..... H01R 39/56; H01R 43/002; H01R 43/14
See application file for complete search history.

(56) References Cited

U.S. PATENT DOCUMENTS 2,439,114 A * 4/1948 Vacha ..... H01R 43/14 524/451
5,416,572 A * 5/1995 Kolb ..... G03G 21/0005 399/350

(Continued)

FOREIGN PATENT DOCUMENTS

CN 104218419 A * 12/2014
DE 29807515 U1 7/1998

(Continued)

OTHER PUBLICATIONS

CN104218419A English translation (Year: 2022).*

(Continued)

*Primary Examiner* — Tulsidas C Patel
*Assistant Examiner* — Viswanathan Subramanian
(74) *Attorney, Agent, or Firm* — The Small Patent Law Group LLC; Christohper R. Carroll

(57) ABSTRACT

The disclosure relates to a slip ring assembly, which has a slip ring body and at least one slip ring arranged on the slip ring body and a contact module having contact elements. The contact elements contact a slideway of the slip ring. A cleaning device is provided for cleaning the slideway. According to the disclosure, the cleaning device has a cleaning brush having a brush filling contacting the slideway.

19 Claims, 2 Drawing Sheets

(56) References Cited

U.S. PATENT DOCUMENTS

| | | | |
|---|---|---|---|
| 6,517,638 | B1 | 2/2003 | Soupart |
| 2017/0093109 | A1 | 3/2017 | Ramachandran |

FOREIGN PATENT DOCUMENTS

| | | | | |
|---|---|---|---|---|
| DE | 10215214 | A1 | 10/2003 | |
| EP | 1105041 | A1 | 6/2001 | |
| WO | WO-2015056294 | A1 * | 4/2015 | ..... H01R 13/5213 |

OTHER PUBLICATIONS

WO2015056294A1 English translation (Year: 2022).*
Office Action for German Application No. 10 2018 120 326.8 dated May 14, 2019; 11pp.
International Search Report of International Application No. PCT/DE2019/100751 dated Nov. 19, 2019; 5pp.
Examination Report dated Jan. 17, 2022 for corresponding Indian Patent Application No. 202147006573 (6 pages).

* cited by examiner

SLIP RING ASSEMBLY

RELATED APPLICATIONS

The present application is a National Phase of International Application Number PCT/DE2019/100751 filed Aug. 20, 2019 claims priority to German Application Number 10 2018 120 326.8 filed Aug. 21, 2018.

FIELD

The disclosure relates to a slip ring assembly.

BACKGROUND

Slip ring assemblies are electromechanical components with the aid of which energy, data and/or control signals are transferred from a rotating to a stationary component, or vice versa. They are used in applications which, owing to their rotational movement, do not enable the supply of energy and data via a fixed line.

A slip ring assembly of the conventional type has a slip ring body and at least one slip ring arranged on the slip ring body and a contact module having contact elements, such as contact springs. In technical terms, a contact module is also known as a brush block. The slip rings and contact elements are essential components of the constructions.

The contact elements contact a slideway of the slip ring and, together with this, form a sliding contact. Owing to the relative movement between the components, slight wear occurs continuously during operation. To keep the wear as low as possible, oil is applied to the sliding contact surfaces. In spite of this lubrication, the wear cannot be prevented. The wear debris binds to the oil and adheres to the components, like the slideway. This contamination is disadvantageous for the transfer of energy and data, and can also cause disruption to the insulation, resulting in operational interruptions.

To eliminate this problem, DE 298 07 515 U1 proposes a rotating cleaning device for continuous cleaning or contamination control of slip ring mechanisms which are worn away by contact. The device has a cleaning roller, which is formed from cleaning rings and is pressed against the slideway. The cleaning roller moves along at a low speed, wherein any dirt present should become embedded in the clearances of the cleaning channel.

In the proposal known from EP 1 105 041 B1, a covering moistened with a liquid is used, which is pressed against the slideway in order to remove contamination and wear debris.

A cleaning system for cleaning a slip ring is discussed in US 2017/0093 109. The cleaning system comprises a cleaning assembly, which is configured such that the cleaning assembly can be positioned in contact with the slip ring. The cleaning assembly can move along the slip ring for cleaning purposes. A control unit associated with the cleaning system is designed to control the function of the cleaning assembly based on user inputs.

A device for cleaning a collector on an electric motor operated with carbon brushes furthermore can be seen in DE 10 215 214. A cleaning module having a movable cleaning brush is arranged on the stator of the electric motor, which cleaning brush is pressed onto the collector by means of a spring and is retracted by means of an electromagnet when an electric voltage is applied to the electric motor.

SUMMARY

The disclosure is based on the object of providing a slip ring assembly having a functionally and operationally improved cleaning device.

A slip ring assembly has a slip ring body and at least one slip ring arranged on the slip ring body and a contact module having contact elements. The contact elements are contact springs. However, other contact elements, for example carbon brushes, can also be used as contact elements. The contact elements contact a slideway of the slip ring.

A cleaning device is provided for cleaning the slideway. The cleaning device has a cleaning brush having a brush filling contacting the slideway.

The cleaning brush picks up the wear debris and provides a thin, even oil film on the slideway. Impairments caused by wear or contamination can thus be prevented. The transfer of energy and/or data between the slip ring or slideway and the contact elements is ensured.

According to the disclosure, the cleaning brush possesses a base body, which has a rear web and a brush carrier. The cleaning brush is fixed on a carrier plate of the contact module via the rear web and connecting elements.

In this way, stable assembly within the slip ring assembly system is possible using the existing installation space. Assembly and dismantling of the cleaning brush are simple. The cleaning brush is replaceable when necessary. The existing slip ring assemblies can be retrofitted with an inventive cleaning device.

The cleaning brush extends transversely over the width of the carrier board.

In at least one embodiment, the brush carrier protrudes transversely to the rear web at a right angle, in the direction of the slideway. A compact design of the cleaning brush is thereby possible, with efficient cleaning of the slideway via the brush filling.

The brush filling is formed from fibers, bristles or wires made of an electrically non-conductive material.

The brush set can be made of a variety of materials, such as a brush filling with fibers made of polyamide.

The assembly of the cleaning brush takes place via connecting means. These can be form- and/or force-fitting connecting means. One type of connecting means can be clips, which can be latched into compatibly configured openings or counter-holders. A screw-type fixing of the cleaning brush in the system is also possible on the carrier board of the contact module.

In this connection, a yoke-type counter-bearing piece cooperates with connecting means to fix the cleaning brush in position. Connecting means can be screw connection elements, for example screws and threaded bores or nuts. Latching connecting means, which connect the cleaning brush to the carrier board via the counter-bearing piece, are also possible.

Such a counter-bearing piece has a receiving means adapted to the width and the thickness of the carrier board. The counter-bearing piece can be positioned on that side of the carrier plate which is opposite the cleaning brush and, in this case, surrounds the carrier board with the receiving means. Connecting means, for example threaded bores or assembly openings, for guiding-through or receiving screw connection means are provided in the end regions of the counter-bearing piece in each case.

BRIEF DESCRIPTION OF THE DRAWINGS

The disclosure is described in more detail below with reference to drawings, in which.

The figures use the same reference numerals for identical or similar components, even when there is no repeated description on grounds of simplification.

DETAILED DESCRIPTION

Figure 1:
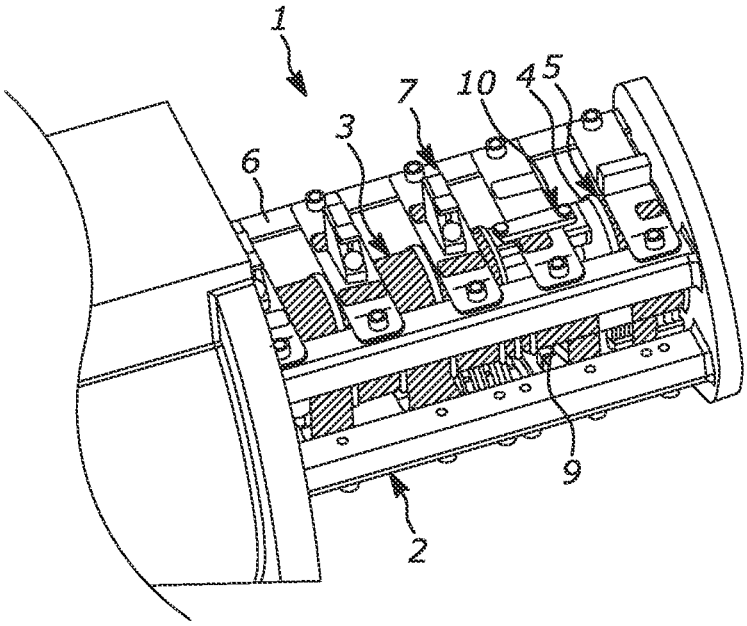
FIG. 1 shows an inventive slip ring assembly in a perspective illustration in accordance with at least one embodiment.

FIG. 1 shows a detail of an arrangement having a slip ring assembly 1 installed therein.

The slip ring assembly 1 comprises a stationary machine part (stator) 2 and a rotating shaft (rotor) 3 on which a slip ring body 4 and slip rings 5 are arranged.

Contact modules 7 are assembled on supporting arms 6 of the stator 2. The contact modules 7 have contact elements in the form of contact springs 8. The contact elements are in sliding contact with slideways 9 of the slip rings 5. Electric currents or energy and data are transferred from the stationary machine part 2 to the shaft 3 or in the reverse direction, depending on the application.

A cleaning device 10 is provided for cleaning the slideways 9. Only one cleaning device 10 is illustrated in FIG. 1. Each contact module 7 can be equipped with a cleaning device 10.

Figure 2:
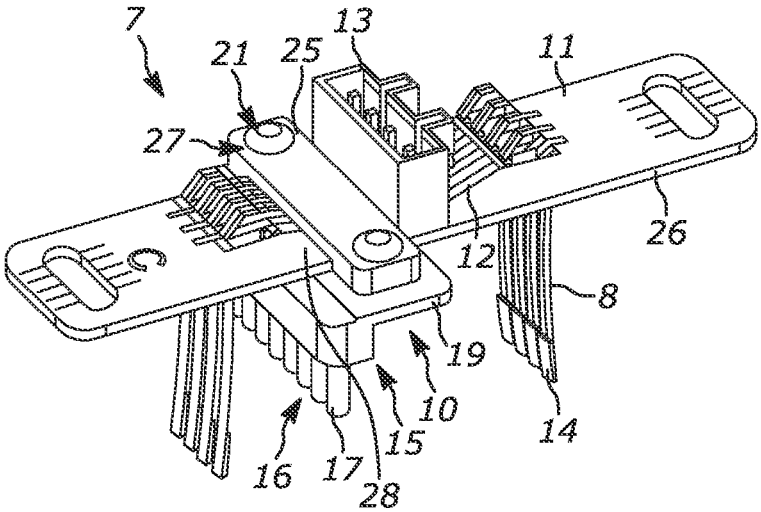
FIG. 2 shows a contact module having an assembled cleaning device, likewise in a perspective illustration in accordance with at least one embodiment.

A contact module 7 having an assembled cleaning device 10 can be seen in more detail in FIG. 2. The cleaning device 10 is incorporated between the contact springs 8.

The contact module 7 possesses a carrier board 11 and is equipped with strip conductors 12, which are connected in an electrically conductive manner to the contact springs 8 assembled on the carrier board 11. The strip conductors 12 lead to a plug contact 13 via which an electrical connection can be established. Reinforced contact regions 14, with which the contact springs 8 contact the slideways 9 of the slip rings 5, are formed at the free ends of the contact springs 8.

A cleaning device 10 has a cleaning brush 15 having a brush filling 16. The cleaning brush 15 contacts one or more slideways 6 by means of the brush filling 16. The brush filling 16 has fibers 17 made of polyamide.

Figure 3:
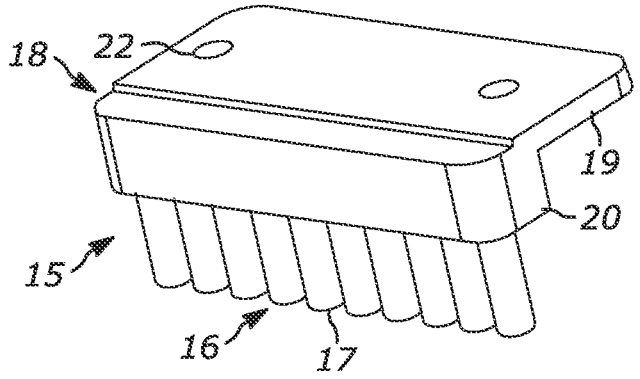
FIG. 3 shows a first configuration of a cleaning brush in accordance with at least one embodiment.
Figure 4:
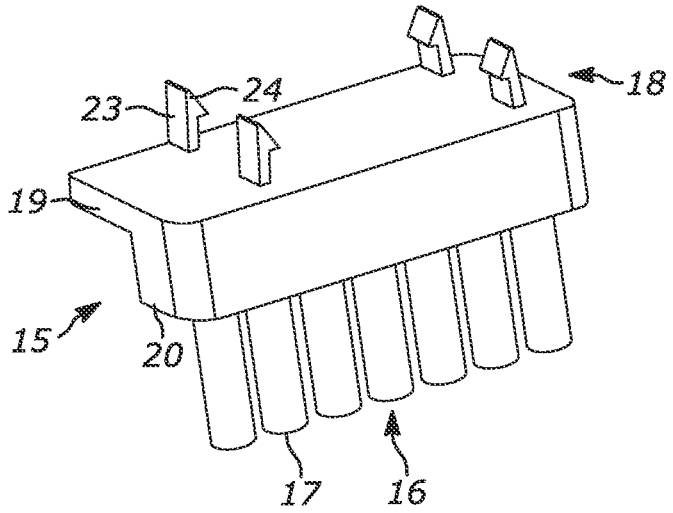
FIG. 4 shows a cleaning brush in accordance with at least one embodiment.

Two configurations of a cleaning brush 15 are illustrated in FIGS. 3 and 4. Each cleaning brush 15 possesses a base body 18, which has a rear web 19 and a brush carrier 20. The cleaning brush 15 is fixed on the carrier board 11 of a contact module 7 underneath the carrier board 11 via the rear web 19 and connecting elements 21. The cleaning brushes 15 in the illustrations of FIGS. 3 and 4 differ in terms of the manner in which they are fixed in position. In the case of the cleaning brush 15 which can be seen in FIG. 3, assembly openings 22 for guiding-through screw connection means are provided in the rear web 19.

The cleaning brush 15 according to the illustration of FIG. 4 has spring clip elements 23 which protrude from the rear web 19 and have hook-like projections 24.

The brush carrier 20 protrudes transversely to the rear web 19, at a right angle thereto, in the direction of the slideway 9. The fibers 17 of the brush filling 16 are single-row fibers, i.e. formed in one row. However, a plurality of rows of fibers 17 can be provided in the brush filling 16.

The cleaning device 10 in the embodiment according to the illustration of FIG. 2 is fixed on the carrier board 11 of the contact module 7 by means of a yoke-type counter-bearing piece 25. The counter-bearing piece 25 extends beyond the long sides 26 of the carrier board 11. In the end regions 27, the counter-bearing piece 25 is clamped to the cleaning brush 15 via the rear web 19 by connecting elements 21 in the form of screws. To this end, the connecting elements 21 in the form of screws are inserted into the assembly opening 22 in the rear web 19 through openings in the counter-bearing piece 25.

The counter-bearing piece 25 has a receiving means 28 adapted to the width and the thickness of the carrier board 11. In this way, the counter-bearing piece 25 can reach over the carrier board 11 in the region of the strip conductors 12 and be clamped to the cleaning brush 15.

By way of the brush filling 16 having the fibers 17 contacting the slideways 9, the cleaning brush 15 picks up any wear debris in the region of the slideways 9 and provides for the distribution of the applied oil, so that a thin, even oil film is ensured on the slideways) 9.

The foregoing description of some embodiments of the disclosure has been presented for purposes of illustration and description. The description is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. Various changes, substitutions and alterations can be made hereto without departing from the spirit and scope of the disclosure.

The invention claimed is:

1. A slip ring assembly comprising:

a contact module having a carrier board with first contact elements and second contact elements extending from the carrier board toward a slip ring of a rotor; and a cleaning device for cleaning the slip ring, the cleaning device comprising a cleaning brush extending toward the slip ring from the carrier board and located between the first contact elements and the second contact elements, the cleaning brush comprising a base body having a rear web and a brush carrier, the cleaning brush fixed on the carrier board of the contact module via the rear web and connecting elements.

2. The slip ring assembly as claimed in claim 1, wherein the cleaning brush transversely extends over a width of the carrier board.

3. The slip ring assembly as claimed in claim 1, wherein the brush carrier transversely protrudes to the rear web at a right angle to the slip ring.

4. The slip ring assembly as claimed in claim 1, further comprising a counter-bearing piece that cooperates with the connecting elements to fix the cleaning brush in position.

5. The slip ring assembly as claimed in claim 4, wherein the counter-bearing piece has at least a width and a thickness of the carrier board.

6. The slip ring assembly as claimed in claim 1, wherein the cleaning brush comprises one or more of fibers, bristles, or wire.

7. The slip ring assembly as claimed in claim 1, wherein the cleaning brush includes a cleaning brush filling comprising polyamide.

8. The slip ring assembly as claimed in claim 1, wherein the first and second contact elements include contact springs.

9. An assembly comprising:

a cleaning device having a cleaning brush with a brush filling configured to contact a slip ring on a rotor, the cleaning brush including a base body having a rear web and a brush carrier, the cleaning brush fixed on a carrier board of a contact module having first contact elements and second contact elements, the cleaning brush disposed between the first contact elements and the second contact elements, the cleaning brush positioned to contact the slip ring.

10. The assembly of claim 9, wherein the cleaning brush transversely extends over a width of the carrier board.

11. The assembly of claim 9, wherein the brush carrier transversely protrudes to the rear web at a right angle to the slip ring.

12. The assembly of claim 9, further comprising a counter-bearing piece that fixes the cleaning brush in position.

13. The assembly of claim 12, wherein the counter-bearing piece has at least a width and a thickness of the carrier board.

14. The assembly of claim 9, wherein the brush filling comprises one or more of fibers, bristles, or wire.

15. The assembly of claim 9, wherein the brush filling includes polyamide.

16. The slip ring assembly of claim 1, wherein the contact module is configured to hold the cleaning device stationary while the slip ring and the rotor move relative to the cleaning device.

17. The slip ring assembly of claim 1, wherein the first contact elements are arranged in a first row transversely oriented relative to the slip ring, the second contact elements are arranged in a second row transversely oriented relative to the slip ring, and the cleaning brush includes a brush filling arranged in a third row transversely oriented relative to the slip ring and disposed between the first row and the second row.

18. The assembly of claim 9, further comprising the contact module, wherein the contact module is configured to hold the cleaning device stationary while the slip ring and the rotor move relative to the cleaning device.

19. The assembly of claim 9, wherein the first contact elements are arranged in a first row transversely oriented relative to the slip ring, the second contact elements are arranged in a second row transversely oriented relative to the slip ring, and the brush filling is arranged in a third row transversely oriented relative to the slip ring and disposed between the first row and the second row.

* * * * *